US007917974B2

(12) United States Patent
Casadio

(10) Patent No.: US 7,917,974 B2
(45) Date of Patent: Apr. 5, 2011

(54) SET OF MODULAR PANELS FOR PROVIDING WATER CONTAINMENT TANKS AND ADJACENT STRUCTURES

(76) Inventor: Gianluca Casadio, Bologna (IT)

( * ) Notice: Subject to any disclaimer, the term of this patent is extended or adjusted under 35 U.S.C. 154(b) by 1172 days.

(21) Appl. No.: 11/512,282

(22) Filed: Aug. 30, 2006

(65) Prior Publication Data

US 2007/0051056 A1 Mar. 8, 2007

(30) Foreign Application Priority Data

Sep. 6, 2005 (IT) ..... BO2005A0547

(51) Int. Cl.
*E04H 4/00* (2006.01)

(52) U.S. Cl. ..... 4/506

(58) Field of Classification Search ..... 4/506, 614; 52/169.7, 238.1, 578, 586
See application file for complete search history.

(56) References Cited

U.S. PATENT DOCUMENTS 3,971,075 A * 7/1976 Heinbaugh et al. ..... 52/169.7
5,720,056 A * 2/1998 Aymes ..... 4/488

FOREIGN PATENT DOCUMENTS

| | | | |
|---|---|---|---|
| DE | 297 21 919 | U1 | 3/1998 |
| EP | 1 302 610 | A | 4/2003 |
| FR | 2 442 939 | A | 6/1980 |
| GB | 2 321 662 | A | 8/1998 |
| WO | WO 01/98606 | A | 12/2001 |

* cited by examiner

*Primary Examiner* — Huyen Le
(74) *Attorney, Agent, or Firm* — Modiano & Associati; Albert Josif; Daniel J. O'Byrne

(57) ABSTRACT

A set of modular panels for providing water containment tanks and adjacent structures. The set comprises at least one panel, which is made at least partly of composite material which is substantially water-repellent and has any shape and size depending on design requirements, the perimetric walls of each panel being provided with watertight anchoring to the contiguous panels.

15 Claims, 2 Drawing Sheets

SET OF MODULAR PANELS FOR PROVIDING WATER CONTAINMENT TANKS AND ADJACENT STRUCTURES

The present invention relates to a set of modular panels for providing water containment tanks and adjacent structures: in particular, such panels are adapted to provide swimming pools and fountains of any shape and size.

BACKGROUND OF THE INVENTION

The swimming pools can be of the ground-level type, in which the water surface is substantially at the same level as the walking surface, or their base can rest on the walking surface.

The ground-level type entails providing an excavation in which the electrical and water supply systems are to be arranged; the bottom and side walls of the excavation must be consolidated conveniently (arrangement of plinths and/or castings of concrete optionally reinforced with metallic nets).

The standard embodiment entails lining the walls of the excavation with suitable ceramic tiles, which are fixed by means of hydrophobic adhesives in order to prevent infiltrations into the concrete, which might damage the structure.

There are constructive solutions adapted to simplify installation: the excavation can in fact be lined with prefabricated panels (generally made of cement material), which are arranged in mutual contact until they surround the excavation perimetrically.

Waterproofing is obtained by lining the panels and the bottom of the pool with a sheath of polymeric material (generally polyvinyl chloride, PVC). The sheath is conveniently preformed and ensures adhesion to the walls and to the bottom without particular fixings: by virtue of the hydrostatic thrust provided by the water that fills the pool, the sheath is in fact compressed against the panels and the bottom.

This constructive solution, which is simple to apply, may not be welcomed by the user, since the tactile feeling of polymeric material is substantially different from the traditional feeling of tiles.

Secondly, installation (while being simplified with respect to traditional installation) is still complex and requires a perfect match between the design and its execution, on penalty of imperfect mating between the sheath and the walls/bottom.

One characteristic that is increasingly interesting for the buyer of a swimming pool or fountain or optionally of a pond is perfect aesthetic integration with the installation environment.

The built structure must therefore have a suitable shape (therefore the shape should be decided in each instance without any building constraint) and the materials that constitute it should have a color that harmonizes with the outside environment.

With the described constructive solutions, this is practically impossible: as regards traditional constructions, shape can be substantially modified at will and so can the choice of the color of the tiles of the cladding, but the labor and material costs can become prohibitive.

With the solution that provides the sheath made of polymeric material, the constructive limitations are evident: the prefabricated panels have preset shapes and dimensions and therefore force the choice of substantially mandatory installation criteria.

SUMMARY OF THE INVENTION

The aim of the present invention is to obviate the cited drawbacks and meet the mentioned requirements, by providing a set of modular panels for providing tanks for containing water and adjacent structures that is simple to install and assemble.

An object of the present invention is to provide articles of any shape with colors and finishes that can be customized without requiring further waterproofing.

Within this aim and object, another object of the present invention is to provide a structure which is simple, relatively easy to provide in practice, safe in use, effective in operation, and has a relatively low cost.

This aim and this and other objects that will become better apparent hereinafter are achieved by the present set of modular panels for providing water containment tanks and adjacent structures, characterized in that it comprises at least one of said panels, which is made at least partly of composite material which is substantially water-repellent and has any shape and size depending on design requirements, the perimetric walls of each of said panels being provided with means for watertight anchoring to the contiguous panels.

BRIEF DESCRIPTION OF THE DRAWINGS

Further characteristics and advantages of the invention will become better apparent from the following detailed description of a preferred but not exclusive embodiment of a set of modular panels for providing tanks for containing water and adjacent structures, illustrated by way of non-limiting example in the accompanying drawings, wherein.

DESCRIPTION OF THE PREFERRED EMBODIMENTS

Figure 1:
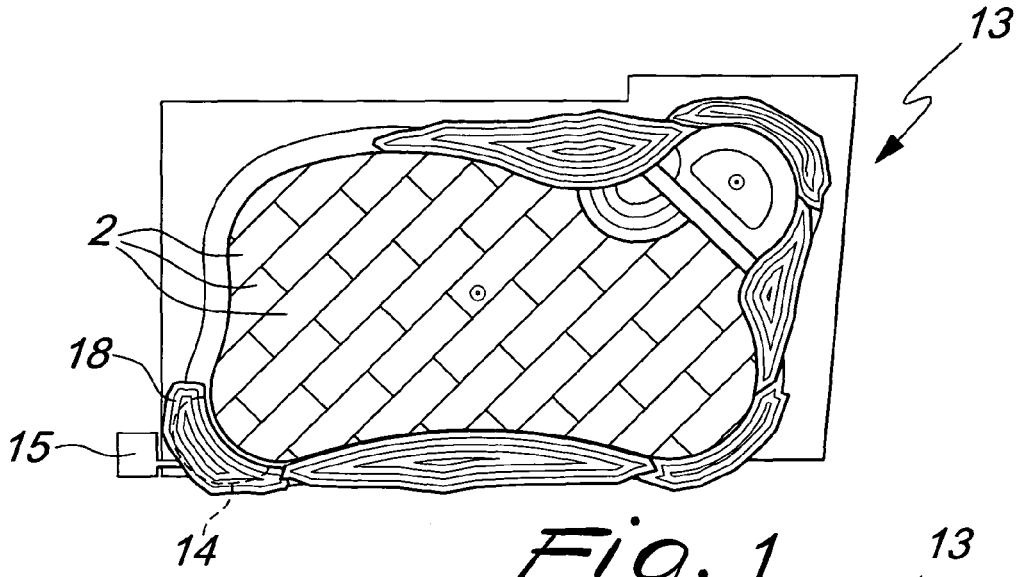
FIG. 1 is a top view of a swimming pool provided by means of modular panels according to the invention.

With reference to the figures, the reference numeral 1 generally designates a set of modular panels for providing tanks for containing water and adjacent structures.

Each panel 2 that belongs to the set 1 is made at least partly of composite material and its shape and dimensions are any according to the design requirements. The composite material is substantially water-repellent, i.e. allows practically no water penetration therethrough.

Figure 3:
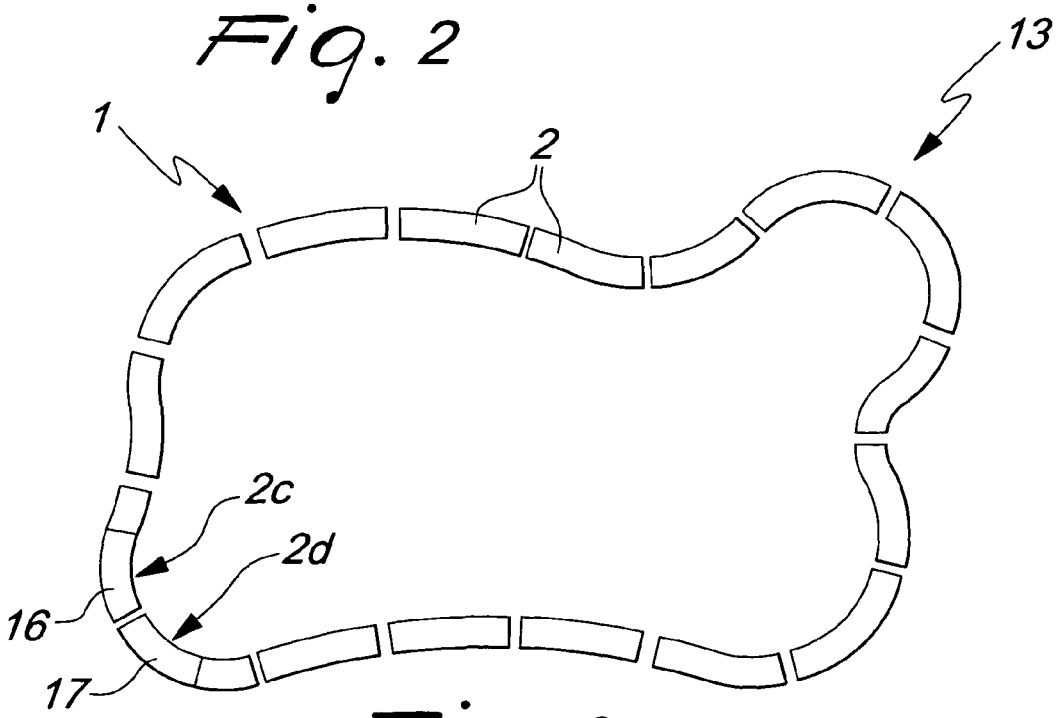
FIG. 3 is a top view of the modular panels according to the invention that constitute the swimming pool of FIG. 1.
Figure 4:
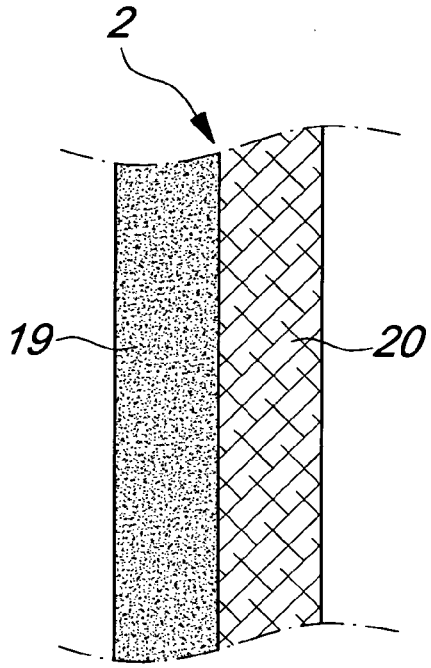
FIG. 4 is a sectional side view, taken along a plane which is perpendicular to its surface, of a panel according to the invention.
Figure 5:
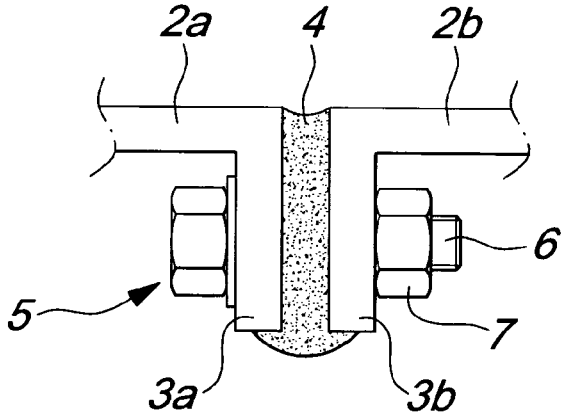
FIG. 5 is a top view of a first constructive embodiment of a portion of a mutual joint between two contiguous panels of a set according to the invention.
Figure 6:
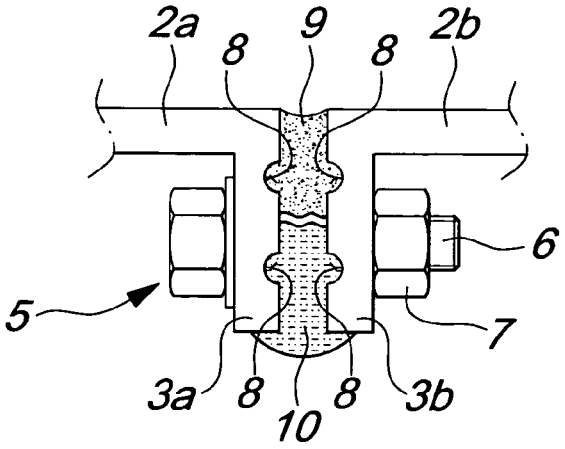
FIG. 6 is a top view of a second constructive embodiment of a portion for mutually joining two contiguous panels of a set according to the invention.

As can be seen in FIGS. 1 and 3, it is in fact possible to shape the panels 2 according to requirements, providing structures of any shape without having to comply with standardization requirements of the panels 2.

The choice of the composite material is in fact dictated by the possibility to obtain it by molding exactly with the required shape.

The perimetric walls of each panel 2 are provided with means for hermetic anchoring to contiguous panels 2.

Among the possible constructive solutions that allow to mutually couple to each other the panels 2, the preferred solution entails that the anchoring means are constituted by a perimetric frame 3*a*, which is rigidly coupled to the panel 2*a* and is adapted to rest against the corresponding frame 3*b* of the contiguous panel 2*b*, even with the interposition of sealing gaskets 4.

The frames 3*a* and 3*b* of contiguous panels 2*a* and 2*b* are mutually coupled detachably by way of fastening elements constituted preferably by bolts 5, the screw 6 of which is inserted within respective holes distributed on the frame 3*a* and on the contiguous frame 3*b*, the frames 3*a* and 3*b* being mutually fastened by means of a respective nut 7.

According to more complex constructive solutions, the frames 3*a* (3*b* . . . ) may have at least one longitudinal groove 8, even a shallow one, for stably accommodating the sealing gasket 4: when mutual fastening of the two frames 3*a* and 3*b* occurs, the gasket 4 is in fact deformed between them and undergoes, at the groove 8, a reduced deformation which helps to lock the gasket 4. If the gasket 4 is provided by forming ridges at the portion that will face the grooves 8, the locking of the gasket 4 and the seal ensured thereby can be even better.

In some constructive solutions, the sealing gaskets are at least two, 9 and 10, arranged substantially parallel to each other. The gasket that lies proximate to the internal surface of the tank, the gasket 9, can be made of a polymeric material of the silicone type, particularly polyurethane silicone, while the other gasket, the gasket 10, can be made of polymeric material (even of a different type): in this manner, an imperfection that allows water to seep through the gasket 9 until it reaches the surface of the gasket 10 is blocked instantly.

Figure 2:
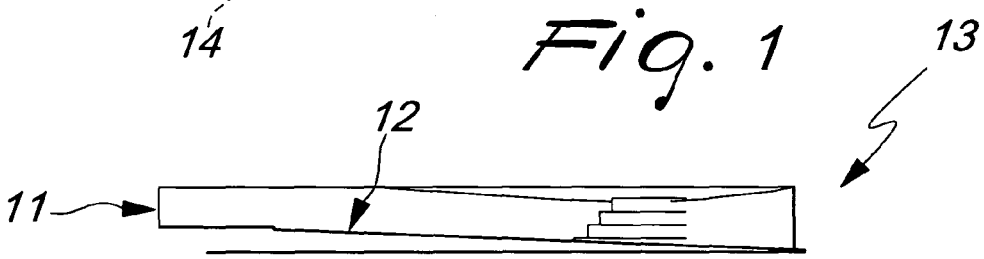
FIG. 2 is a sectional side view, taken along a vertical plane, of a swimming pool provided by means of a modular panel according to the invention.

The panels 2, as shown in FIGS. 1 and 2, can be mutually coupled so as to constitute the walls 11 and the bottom 12 of a swimming pool 13. The panels 2 that constitute the floor can rest on a cement casting (or other type of foundation) and can be optionally rigidly coupled to the casting (foundation) itself depending on the required finish.

Once the panels 2 that constitute the walls 11 and the bottom 12 have been installed in the excavation that will accommodate the tank (swimming pool or fountain or other installation), their stability is ensured by means of the arrangement of radial buttresses, which are rigidly coupled to the outside wall of at least some of the panels 2 and are stably coupled to the footing of the excavation (foundation).

The panels 2 can have anchoring elements with a first surface which is stably embedded within the panel 2 and a second surface which can be fastened onto a corresponding radial buttress.

In this manner, it is possible to arrange around the tank all the circuits designed for water recirculation and any electrical circuits for supplying power to the pumps and lighting of said tank.

The panels 2 can have through holes for accommodating hermetically the parabolic reflector of light sources intended to illuminate the interior of the tank: said sources, when the tank is installed, may also be submerged.

Preferably, at least one panel 2 among the panels that constitute the walls 11 must be lower than the other ones for the outflow of water into an appropriately provided receptacle 14 controlled by a circuit 15 for the recirculation of said water: FIG. 3 shows that the panels 2*c* and 2*d* have for this purpose a reduced height at their portions 16 and 17 respectively, which are substantially aligned with the receptacle 14.

The receptacle 14 is surmounted by a shell 18, which is made of a material similar to the material that constitutes the panels 2 and is provided with a device for dispensing water toward the swimming pool 13; the shell 18 covers completely the receptacle 14, since it can be given the chosen shape and dimensions. Further, the water dispenser is arranged in such a manner as to form a sort of waterfall in front of the portions 16 and 17, making less visible the respective height reduction and accordingly concealing the receptacle 14 and the components of the circuit 15.

The panels 2 are constituted by at least one layer made of cement material 19 and at least one layer of composite material 20: said layers have thicknesses which can vary conveniently according to constructive requirements.

The layer 19 is designed to make the panel 2 waterproof and comprises, in substantially variable quantities, cement, fine sand (having a low particle size) and acrylic resin.

The layer 20 made of composite material comprises a matrix which is constituted by cement, fine sand and acrylic resin; the reinforcement is instead constituted by fibers substantially of the type comprised among glass fibers (a preferred constructive solution consists in using tough alkaline glass fibers), carbon fibers and Kevlar fibers. The choice of glass fiber ensures good cost containment, making the set 1 economically competitive. Other types of fiber can instead ensure better structural properties, with consequent possible applications subject to more intense loads.

The panel 2 therefore has a first layer 19 in contact with the water which is rendered waterproof by enriching the mortar (sand and cement) with a special acrylic resin (added in a percentage of, for example, 20% with respect to the weight of the cement) according to a particular constructive solution: different percentages can be suitable for other constructive solutions): acrylates are a family of polymers that belong to the category of vinyl polymers. Acrylate derive naturally from acrylate monomers: acrylate monomers are esters which contain vinyl groups, i.e., two carbon atoms joined together by a double bond, bound directly to the carbonyl carbon.

The second (composite) layer 20 is rendered particularly tough by enriching the mortar (matrix) with alkaline glass fiber (reinforcement), added in a percentage of for example 5% with respect to the mix (as regards a particular constructive solution; different percentages may be suitable for other constructive solutions).

The element for anchoring to the buttress has its surface embedded within the panel 2 contained within the layer 2 in order to maximize the solidity of the coupling, utilizing the mechanical properties of the reinforcement fibers.

The material used allows a surface finish of great aesthetic impact which can be customized: it is possible to create surfaces that reproduce rock, stone (marbles, granite, . . . ) or optionally mosaics with any coloring.

The particular shape of the panels 2 can be obtained by casting the mixed raw materials (before they harden) within suitable molds provided for this purpose: in this manner, by not having to comply with standardizations forced by the industrial process for forming the panels 2, the tanks that are provided may have any shape and/or size, allowing great versatility of application.

In particular, if the tank being manufactured is small, it can be provided by means of a single panel 2, which is then carried and installed with very short times and low installation costs.

It has thus been shown that the invention achieves the intended aim and objects.

The invention thus conceived is susceptible of numerous modifications and variations, all of which are within the scope of the appended claims.

All the details may further be replaced with other technically equivalent ones.

In the exemplary embodiments shown, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

The embodiment of the present invention shall be carried out in the most scrupulous compliance with the statutory and regulatory provisions related to the products of the invention or correlated thereto and following any required authorization of the corresponding competent authorities, with particular reference to regulations related to safety, environmental pollution and health.

In practice, the materials used, as well as the shapes and dimensions, may be any according to requirements without thereby abandoning the scope of the protection of the appended claims.

The disclosures in Italian Patent Application No. BO2005A000547 from which this application claims priority are incorporated herein by reference.

What is claimed is:

1. A modular panel set for providing water containment tanks and adjacent structures, comprising:

a plurality of panels each made at least partly of composite material which is substantially water-repellent, each of said panels comprising an internal waterproof cement layer for contact with water and an external composite material reinforcement layer and each of said panels comprising perimetric walls; and anchoring means, provided at said perimetric walls, for mutual watertight anchoring a of contiguous said panels.

2. The panel set of claim 1, wherein said panels are shaped so as to form an entire tank, said anchoring means being rigidly coupled to an installation area of the tank.

3. The panel set of claim 2 wherein said anchoring means are constituted by a perimetric frame which is rigidly coupled to each of said panels and is adapted for resting against a respective perimetric frame of a contiguous said panels, and wherein sealing gaskets are providable between said perimetric frames of said contiguous panels, and fastening means, perimetric frames of said contiguous panels being rigidly coupled to each other detachably by way of said fastening means.

4. The panel set of claim 3, wherein said perimetric frames have at least one longitudinal groove for stably accommodating said sealing gasket.

5. The panel set of claim 3, comprising at least two sealing gaskets, arranged so as to be substantially mutually parallel with a first gasket that lies proximate to an internal surface of the tank being made of a silicone polymeric material, and a second gasket being made of polymeric material.

6. The panel set of claim 3, wherein said fastening means comprise bolts, a screw whereof being inserted within respective holes distributed on a said perimetric frame and on a contiguous one, said perimetric frames being mutually fastened with a respective nut.

7. The panel set of claim 1, wherein said contiguous panels are mutually coupled so as to constitute walls and bottom of a swimming pool, at least one of said panels among the ones that constitute the walls being lower than the others for allowing outflow of water into an appropriately provided receptacle controlled by a circuit for recirculating water.

8. The panel set of claim 7, wherein said receptacle is surmounted by a shell made of a material that is similar to a material that constitutes said panels, said shell being provided with a device for dispensing water toward the swimming pool and being adapted to cover completely said receptacle.

9. The panel set of claim 1 wherein said internal waterproof cement layer comprises cement, fine sand, and acrylic resin suitable to make said internal waterproof cement layer waterproof.

10. The panel set of claim 9, wherein said external composite material reinforcement layer comprises a matrix constituted by cement, fine sand, and acrylic resin, said matrix being reinforced with fibers selected among glass fibers, carbon fibers, and Kevlar fibers.

11. A method for manufacturing a water containment tank, comprising:

designing a tank and dividing a surface thereof into a plurality of portions, preparing a plurality of molds, each of which corresponds to a shape and size of a corresponding tank portion with addition of a perimetric frame, pouring into each mold two layers for constituting a respective panel wherein said two layers comprise an internal waterproof cement layer for contact with water and an external composite material reinforcement layer, letting each respective panel harden to form a plurality of panels each of which comprises said internal waterproof cement layer for contact with water and said external composite material reinforcement layer, arranging said plurality of panels at said surface of said tank such that said external composite material reinforcement layer of each of said panels is arranged in contact with said surface of said tank and such that said internal waterproof cement layer of each of said panels is arranged for contact with water and mutually fixing said plurality of panels, by interposing a suitable sealing gasket between perimetric walls of said plurality of panels.

12. The method of claim 11, comprising using said plurality of molds each made of a polystyrene material to which an internal surface substrate is applicable that is provided with a surface finish to be applied to the panel being produced.

13. The method of claim 11, comprising arranging within a said layers for each of said panels at least one surface of an anchoring element, and rigidly coupling a protruding portion of said anchoring elementg to a buttress which is rigidly coupled to an installation area of said tank.

14. The method of claim 11, comprising providing said internal waterproof cement layer made of cement, fine sand, and acrylic resin suitable to make said internal waterproof cement layer waterproof.

15. The method of claim 14, comprising providing said external composite material reinforcement layer made of a matrix constituted by cement, fine sand, and acrylic resin, and reinforcing said matrix with fibers selected among glass fibers, carbon fibers, and Kevlar fibers.

* * * * *